US006148457A

United States Patent [19]

Sul

[11] Patent Number: 6,148,457

[45] Date of Patent: Nov. 21, 2000

[54] STEAM HEATED BED

[76] Inventor: Tae Ho Sul, 9691 Central Ave., Garden Grove, Calif. 92844

[21] Appl. No.: 09/340,851

[22] Filed: Jun. 28, 1999

[51] Int. Cl.[7] ..... A47C 21/04

[52] U.S. Cl. ..... 5/421; 5/284

[58] Field of Search ..... 5/421, 284

[56] References Cited

U.S. PATENT DOCUMENTS

| | | | |
|---|---|---|---|
| 5,146,633 | 9/1992 | Kim et al. | 5/421 |
| 5,259,379 | 11/1993 | Kim et al. | 5/421 X |
| 5,430,900 | 7/1995 | Kim | 5/421 |
| 5,444,878 | 8/1995 | Kang | 5/421 |
| 5,871,151 | 2/1999 | Fiedrich | 5/421 X |
| 5,889,923 | 3/1999 | Lee et al. | 5/421 X |

*Primary Examiner*—Terry Lee Melius
*Assistant Examiner*—Robert G. Santos
*Attorney, Agent, or Firm*—Frank D. Gilliam

[57] ABSTRACT

A bed having a hard sleeping layer with a conduit embedded in the layer. The layer rests on a thermally insulating layer. The conduit loops across the surfaces. A steam generator directs steam through the conduit to warm the bed. The steam passes to a condensor which condenses the steam and passes the resulting water back to the steam generator. Operation of the steam generator is controlled by a thermostat. A sight gage permits observation of the level. An arrangement is provided for flushing the conduit.

7 Claims, 2 Drawing Sheets

STEAM HEATED BED

BACKGROUND OF THE INVENTION

1. Field of the Invention

This invention is directed to a steam heated bad for the comfort of the person or persons sleeping thereon. More particularly, the present invention relates to a bed with a temperature controlled steam heated sleeping surface.

2. Description of the Relevant Prior Art

It is well known that beds can be heated by use of electric blankets, electric sheets, hot water bottles, heated stones, etc.

U.S. Pat. No. 5,871,151 teaches a hydronic radiant heater bed utilizing heated water pumped from a source.

U.S. Pat. No. 5,824,025 teaches the use of heated air to warm a patient during a progressive medical procedure.

There is continuing need for an improved bed with a heated surface bed for sleeping thereon.

SUMMARY OF THE INVENTION

The invention is directed to a conventional bed having a hard sleeping surface. The bed has a conduit embedded in an upper cementitious surface that rests on an insulated surface. The conduit loops between the head board, foot board and sides. The first end of the conduit is connected adjacent to the top of a small steam generator or boiler wherein the water therein is heated by electric current passing through a heating element. The steam flows from the steam generator through the conduit, through a steam to hot water condenser which cools the steam and converts the steam back to hot water and exits the second end of the conduit into the steam generator adjacent the bottom thereof. This cycle is repeated throughout the warming requirements. A slight vacuum is established within the conduit to promote the flow of the steam from the generator through the conduit and return to the steam generator as hot water.

The steam generator is controlled by means of a thermostat which in turn controls the steam generation ans hence the bed surface temperature.

The bed upper sleeping surface of the cementitious material is formed with a thin hard surface material and the steam heat is transferred thereto by convection.

An transparent sight gauge connected in parallel with the conduit second end and the input to the bottom of the steam generator is provided for monitoring and maintaining sufficient water to the steam generator.

A valve is provide parallel connected with the second end of the conduit for flushing the system and a vacuum connection is provided to establish a slight vacuum to the system.

It is therefore the main object of the invention to provide a new and unique method for steam heating a bed with a hard sleeping surface.

BRIEF DESCRIPTION OF THE DRAWING FIGURES

DETAILED DESCRIPTION

Figure 1:
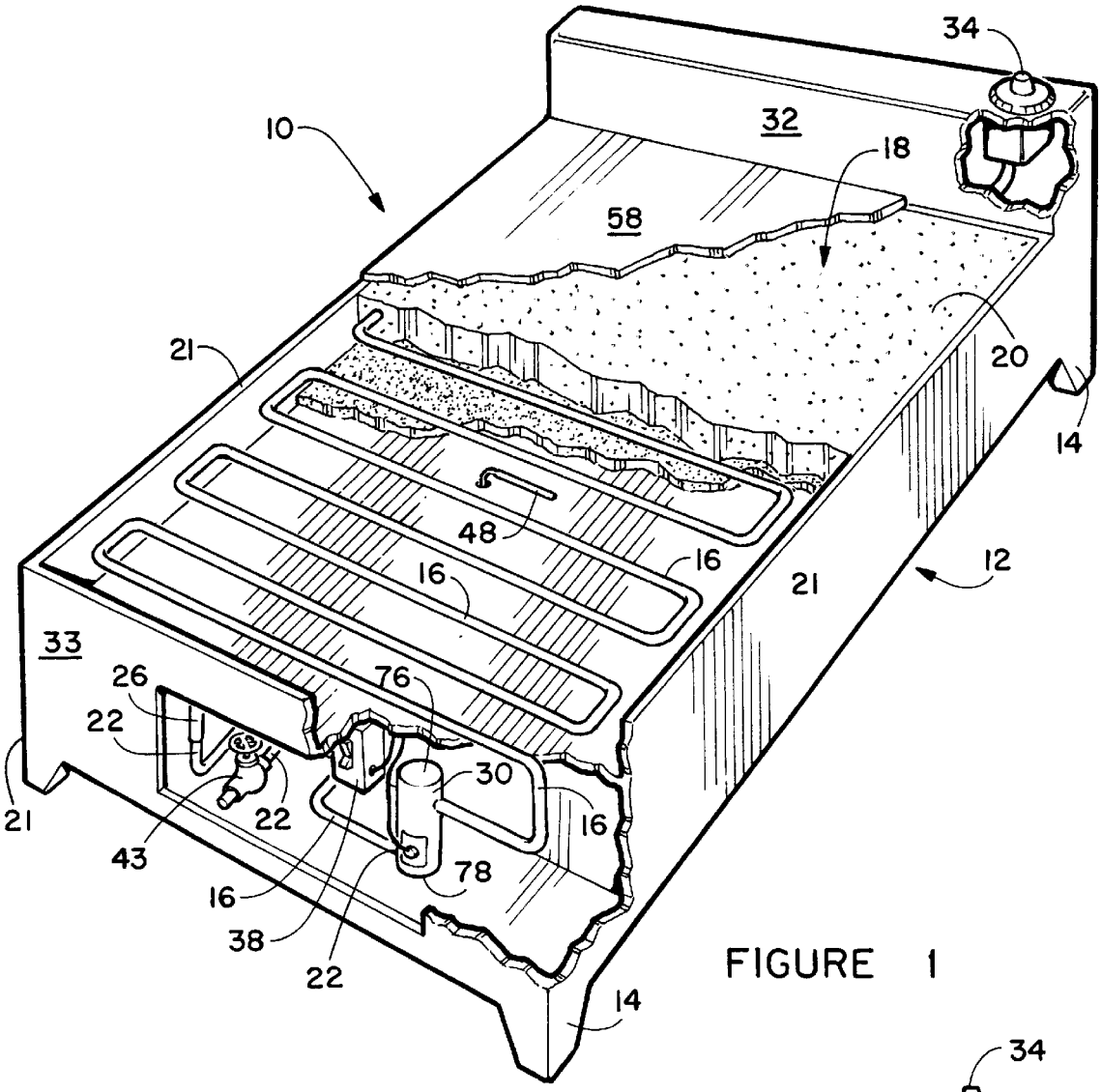
FIG. 1 is a perspective particularly cutaway showing of bed of the invention.
Figure 2:
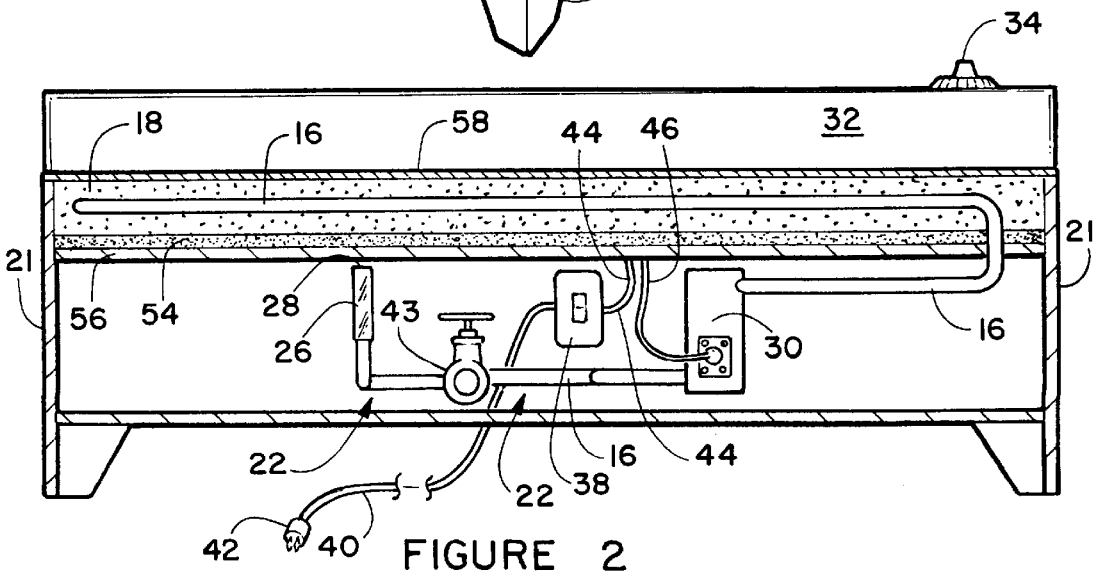
FIG. 2 is a partial cutaway showing of the foot of the bed of the invention.
Figure 3:
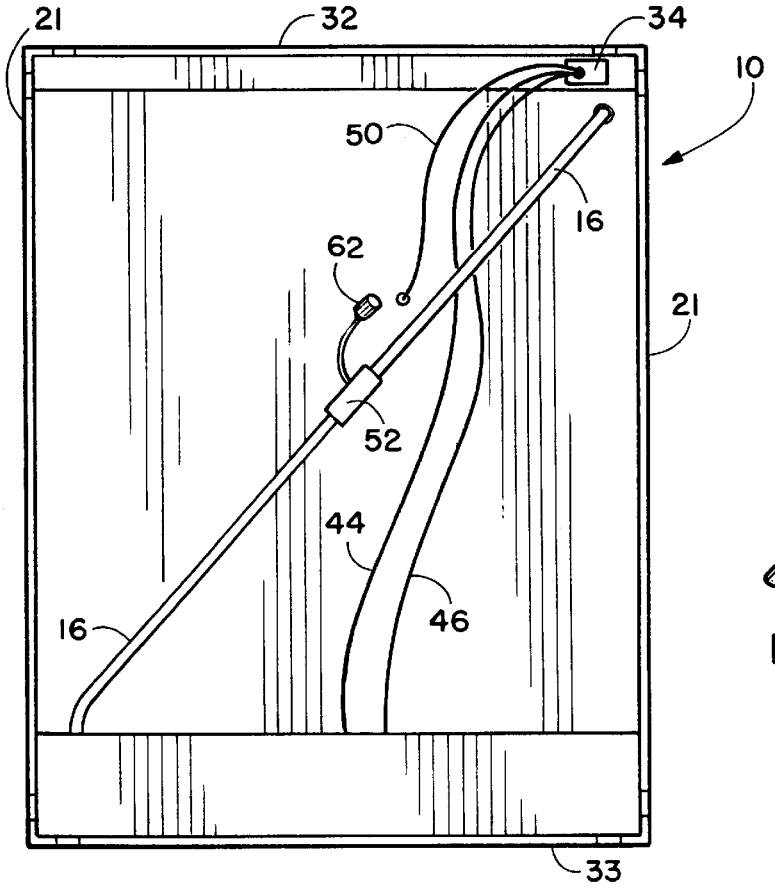
FIG. 3 is a bottom plan view of the bed of the invention.

Referring now specifically to drawing FIGS. 1, 2 and 3. The steam heated bed 10 of the invention includes a conventional bed frame 12 with support legs 14, sides 21, a head board 32 and a foot board 33. A conduit 16, generally formed of copper tubing or the like conduit suitable for the purpose of the invention as herein defined. The conduit is formed in loops that cris-cross the bed from the head board to the foot board between the sides 21 as shown.

As can be seen in the drawings Figures, the conduit 16 is embedded in a layer of cementitious material 18 that is suitable to transfer heat from the conduit, as hereinafter explained, to the upper surface 20 of the bed 10. Any suitable cementitious material suitable for the purpose intended may be utilized.

At end 22 of the conduit is connected to a valve 24 is installed for the purpose of occasionally flushing out the system.

Attached to the conduit in parallel with the valve is a transparent sight gauge 26 open at the top 28 for the purpose of maintaining the correct level of liquid in the steam generator 30, hereinafter discussed in more detail, and for adding lost water to the system through the open top 28.

At the headboard 32 of the bed 10 is positioned a temperature control thermostat 34 for regulating the steam generator 30 and the resulting temperature of the upper surface 20 of the bed.

A conventional AC on-off switch 38 is connected to a convenient AC source through leads 40 and plug 42. The on-off switch 38 when in the "on" position supplies AC current through the wires 44 to the thermostat 34 which supplies AC current through wires 46 to the steam generator 30 and accordingly when the switch 38 is in the "off" position terminates the AC current to the system.

A temperature probe 48 such as, for example and not by way of limitation, a thermocouple or a thermistor, is interconnected through wires 50 to the temperature control thermostat that regulates the temperature of the bed upper surface 33. As the temperature probe 48 indicates that AC current needs to be supplied to the steam generator 30, AC current is then supplied via the thermostat control to the steam generator which in turn generates steam that travels through the conduit 16, through the cementitious material and into a condenser 52 that converts the steam into heated water which is then returned to the steam generator for steam regeneration.

Referring now specifically to drawing FIGS. 1 and 2, an insulating layer 54 is positioned under the cementitious material 20 and the bottom surface 56 of the bed 10. This insulation material 54 can be formed of any suitable insulation material such as plastic foam or the like.

The upper surface 33 of the bed 10 is covered with a hard surface material 58 such as tile, linoleum, or the like that has a good heat transfer.

The bottom surface 56 is constructed of hard material such as, wood or the like, supports the insulating layer 56, cementitious material 18 and hard surface material 58.

Figure 4:
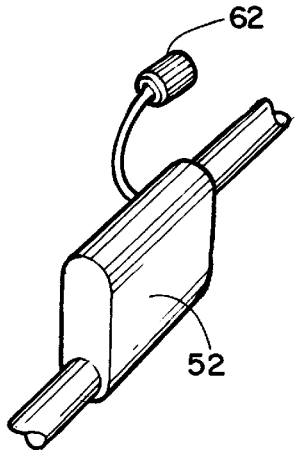
FIG. 4 depicts a perspective showing of the steam condenser of FIG. 3.

Referring now specifically to drawing FIG. 4, the steam to hot water condenser 52 is elongated from top to bottom. The steam enters the top of the condenser is condensed to hot water due to the cooler surface area that the steam encounters and leaves the condenser as hot water. A fitting 62 which is connected to the condenser is normally sealed off and is used to attach a vacuum source to create a slight vacuum to the system. The vacuum is created by a conventional vacuum source such as a compressor or the like, not shown.

Figure 5:
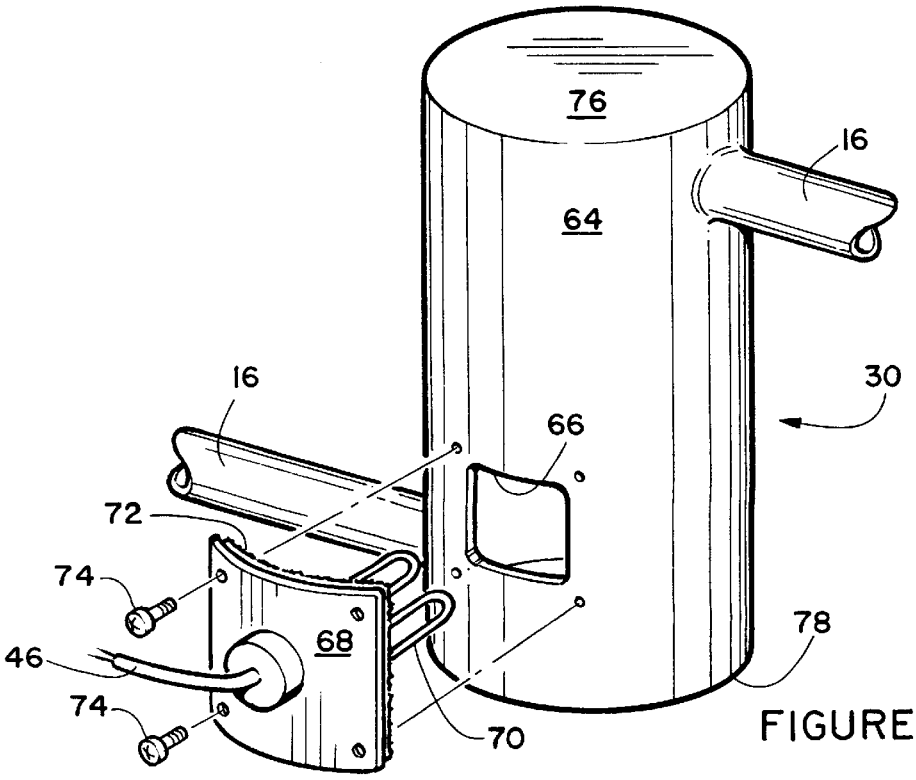
FIG. 5 is an exploded view of the steam generator of the invention.

Referring now specifically to drawing FIG. 5, the steam generator 30 comprises a tank 64 having an opening 66 which receives a plate 68 which includes the heating element 70. The heating element 70 is a resistor of approximately 1 ohm. The heating element is not unlike an instant heater for a cup of tea or instant coffee. The plate 68 has a gasket 72 positioned on the inner tank mating side. The plate and gasket can be attached by any convenient means such as, but not limited to four screws 74, two shown.

The conduit 16 adjacent the top 76 of the tank 64 is the steam outlet and the conduit entering the steam condenser adjacent to the bottom 78 of the tank 64 is the hot water return from the condenser 52.

The level of liquid in the tank 64 is substantially equal to the water level in the sight gauge 28 as they are positioned at equal elevations on parallel planes.

The present disclosure includes that contained in the appended claims, as well as that of the foregoing description. Although this invention has been described in its preferred form with certain degree of particularity, it should be understood that the present disclosure of the preferred form has been made only by way of example and that numerous changes in the details of construction and the combination and arrangements of parts may be resorted to without departing from the spirit and scope of the invention.

What is claimed is:

1. A steam heated bed for human sleeping comprising:

a bed frame having an end, side surfaces, a bottom surface, a head board and a foot board, said bottom surface extending from said head board, said foot board and said side surfaces;

an insulating material positioned on and covering said bottom surface;

a layer of cementitious material positioned on said insulating material;

a conduit having a first and second end, a portion of said conduit being embedded within said cementitious material forming heating loops that cris cross the width and length of said cementitious material;

a layer of hard firm material positioned on the upper exposed surface of said cementitious material;

a steam generating means positioned normal to said cementitious material, said steam generating means having a top and bottom end, said first end of said conduit connected adjacent to said top end of said steam generating means for delivering steam to said conduit and said second end of said conduit connected adjacent to said bottom end of said generating means for receiving return heated water from said conduit;

connection means communicating with said conduit for establishing a slight vacuum within said conduit; and control means for controlling steam generation.

2. The invention as described in claim 1 additional comprising a steam to hot water condenser.

3. The invention as described in claim 1 additional comprising a steam to hot water condenser, an inlet valve for filling and flushing said conduit, steam generating means and said condenser.

4. The invention as described in claim 1 additional comprising a combination liquid sight gauge and conduit filling means, said sight gauge positioned on a plane substantially parallel to said steam generating means connected in parallel to the bottom end of said steam generating means and said second end of said conduit.

5. The invention as described in claim 1 wherein said steam generating means comprises a vertically positioned tank with an electric heating element therein.

6. The invention as described in claim 1 wherein said steam generating means comprises a vertical tank with an electric heating element therein and said control means for controlling steam generation comprises a temperature sensing means and a rheostat for controlling current to said electric heating element.

7. The invention as described in claim 6 additionally comprising an "off" and "on" switch for controlling current to said control means.

* * * * *